US005447313A

United States Patent [19]

Finley

[11] Patent Number: 5,447,313

[45] Date of Patent: Sep. 5, 1995

[54] GOLF PUTTER WITH FOLDABLE AIMING DEVICE

[76] Inventor: Richard O. Finley, 1358 Shelley, Upland, Calif. 91786

[21] Appl. No.: 280,056

[22] Filed: Jul. 25, 1994

[51] Int. Cl.[6] ..... A63B 69/36

[52] U.S. Cl. ..... 273/187.4; 273/194 A; 273/163 R

[58] Field of Search ..... 273/187.4, 186.2, 193 R, 273/194 R, 194 A, 164.1, 163 A, 162 R, 77 R, 167 R, 163 R

[56] References Cited

U.S. PATENT DOCUMENTS

| | | | |
|---|---|---|---|
| 1,173,384 | 2/1916 | Rees | 273/187.4 |
| 1,536,512 | 5/1925 | McLaren | 273/194 R |
| 1,659,231 | 2/1928 | Baack . | |
| 3,198,525 | 8/1965 | Smith | 273/194 A |
| 3,273,893 | 9/1966 | Duncan | 273/163 A |
| 3,667,761 | 6/1972 | Palotsee | 273/187.4 |
| 3,873,094 | 3/1975 | Sebo et al. . | |
| 3,880,430 | 4/1975 | McCabe | 273/187.4 |
| 3,917,277 | 11/1975 | Beck et al. . | |
| 4,136,877 | 1/1979 | Antonious | 273/187.4 |
| 4,291,883 | 10/1981 | Smart et al. . | |
| 4,647,045 | 3/1987 | Bilyeu | 273/194 R |
| 4,674,045 | 3/1987 | Bilyeu . | |
| 4,789,158 | 12/1988 | Chiesa . | |
| 5,078,398 | 1/1992 | Reed et al. . | |
| 5,131,656 | 7/1992 | Kinoshita . | |
| 5,197,737 | 3/1993 | Desbiolles et al. . | |
| 5,213,332 | 5/1993 | Fahy | 273/187.4 |

FOREIGN PATENT DOCUMENTS 2840 of 1901 United Kingdom .

*Primary Examiner*—Sebastiano Passaniti
*Attorney, Agent, or Firm*—John E. Vanderburgh

[57] ABSTRACT

A golf putter is described mounting an elongated aiming arm which can be moved between an extended operative position and a folded storage position against the rear face of the putter head. Means are provided in the rear face of the putter head for adjustably engaging the arm when moved into its operative position to limit its travel between the folded position and the operative position and to maintain the arm in a precise perpendicular relationship to the striking face of the putter head. The aiming arm is pivotally mounted on the rear face of the club head by means of a socket which is located in the rear face of the club head and the arm is provided with a ball on one end which is received in the socket for pivotally mounting the arm. A spring loaded plunger and a circumfeential groove on the ball define a detent for securing the aiming arm in its operative position. A dimple on the innermost pole of the ball cooperates wuth the plunger to define a detent for securing the arm in its folded postion. An adjustable stop engages the aiming arm in the operative position to maintain the aiming arm precise perpendicular relationship to the striking face of the putter head.

6 Claims, 5 Drawing Sheets

GOLF PUTTER WITH FOLDABLE AIMING DEVICE

FIELD OF THE INVENTION

The present invention relates generally to golf clubs and more particularly to a golf putter having an aiming device to assist in the proper alignment of the striking face of the putter.

BACKGROUND OF THE INVENTION

In the game of golf the putter and putting stroke are undoubtedly the most important aspects of the game. The putter is used on every hole and poor putting can lead to high scores even when the player is hitting the ball well with other clubs in the golf bag. Although the putting stroke appears to be simple and is probably the least practiced by the average player, the putting stoke is the least tolerant of errors. For example misalignment of the putting blade of only 0.004 inches on a ten foot putt can cause the ball to miss the hole by 5 inches.

Various devices have been designed to aid the player in proper alignment of the striking face of the putter blade. Among the most common of these aides are those consisting, in one form or the other, of elongated members which extend from the back face of the putter and which are utilized as aiming devices to align the striking face of the club. These devices, such as shown in U.S. Pat. Nos. 1,659,231, 3,917,277, 4,291,883, 4,647,045 and 4,789,158 all include elongated members which extend normally from the club face and which are supported by various mechanisms, either on the club head itself or, as in the case of 4,781,958 on the club shaft. The devices are normally removable from the club head since such devices can not be utilized during tournament play pursuant to the rules of the various golf regulating bodies. Several of the devices are designed to permit moving the elongated setting number into a position where the club can be stored in the golf bag without interference by the sighting device.

Although these devices in principal are effective, it should be understood that the manufacturing tolerances of an device of the type being discussed is critical in order to maintain a precise relationship between the aiming member and the striking face of the putter. As pointed out above a very minor error in alignment of the arm can result in missed putts and, in such a case, the aiming device may in fact cause the player to misalign the striking face of the club more than if the club was aligned by the player without any aiming aids. The manufacturing costs to achieve the necessary tolerances can add substantially to the selling price of an aiming device and in some cases tolerances may be sacrificed to keep the selling price as low as possible.

Accordingly, it would be highly desirable to provide an aiming aid for a golf putter which is inexpensive to manufacture by eliminating much of the criticality of machining tolerances and the resultant errors in club face alignment which can result from sloppy tolerances.

SUMMARY OF THE INVENTION

In accordance with the present invention a golf putter is provided having means for mounting an elongated aiming arm which can be moved between an extended operative position and a folded storage position against the rear face of the putter head. Means are provided in the rear face of the putter head for adjustably engaging the arm when moved into its operative position to limit its travel between the folded position and the operative position and to maintain the arm in a precise perpendicular relationship to the striking face of the putter head.

More particularly, the aiming arm is pivotally mounted on the rear face of the club head by means of a socket which is located in the rear face of the putter head intermediate of the toe and heel of the club head generally opposite the point on the striking face where contact with the ball is to be made. The arm is provided with a ball on one end which is received in the socket for pivotally mounting the arm on the rear face of the putter head. A circumferential groove running essentially parallel to the equator of the ball is provided in the surface of the ball and a dimple is provided at the innermost pole of the ball. A securing member carries a spring loaded plunger which is urged into the groove when the arm is in its operative position and into the dimple when it is in the fully folded position.

An adjustable stop is provided for limiting travel of the aiming arm between the folded position and the fully extended position. The adjustable stop cooperates with the securing member to maintain the arm in a precise perpendicular relationship to the striking face of the putter.

In yet another embodiment of the invention, a groove in the upper face of the putter head is vertically aligned with the extending arm when the club head is in the normal striking position. By aligning the groove over the aiming arm, the player is thereby assured of the proper head position over the ball while lining up a putt.

The length of the arm is not critical although it is highly preferred that the arm not extend beyond the toe of the putter head when it is in the folded position.

These and other advantages and features of the present invention will become apparent from the following detailed description taken into conjunction with the drawings.

DETAILED DESCRIPTION OF THE INVENTION

Figure 1:
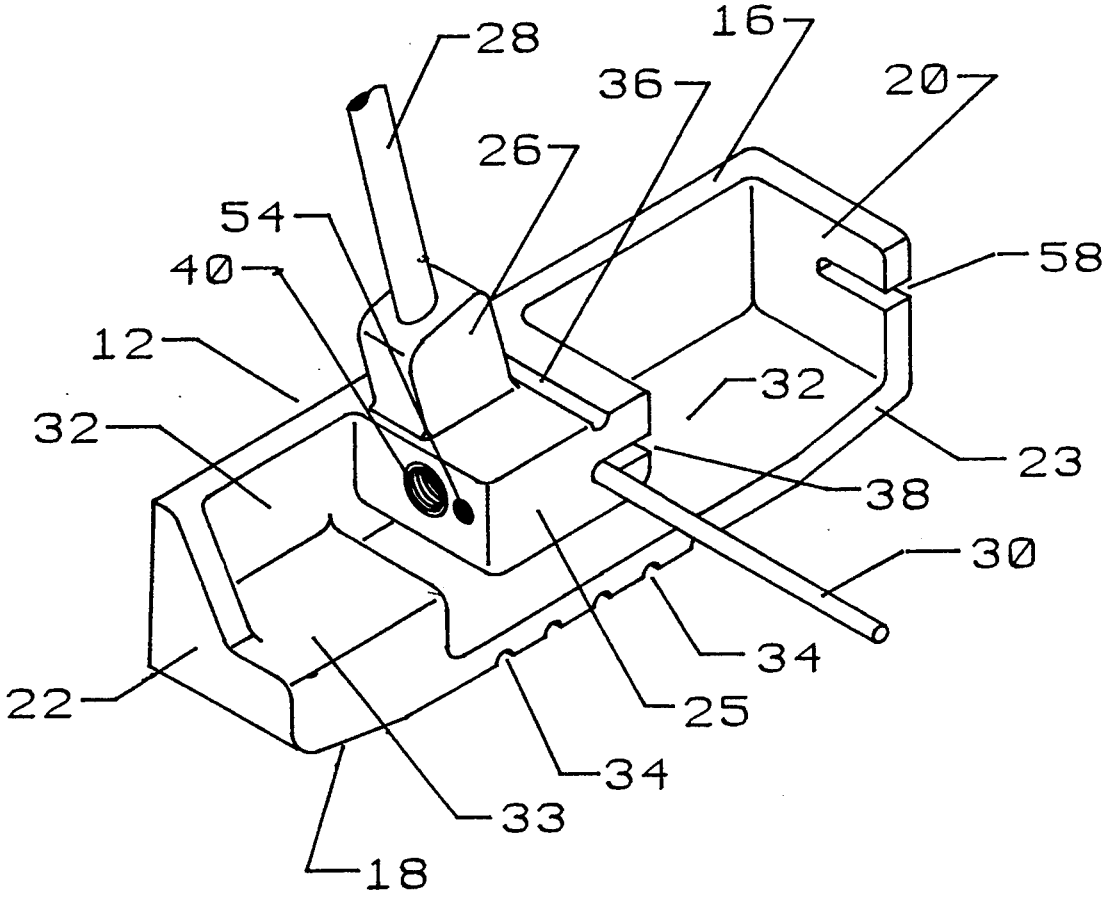
FIG. 1 is a perspective view partially broken away for compactness of illustration showing the rear face of a putter in accordance with the present invention with the aiming arm in the operative extended position.
Figure 2:
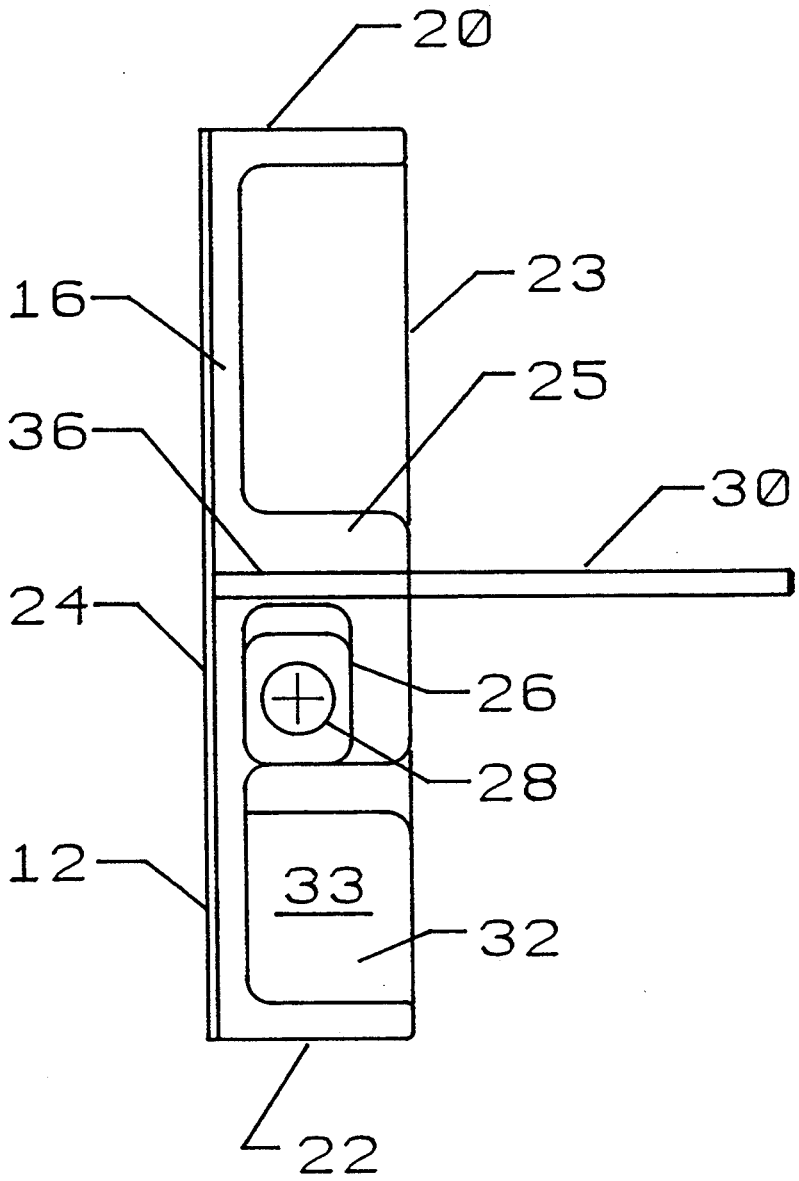
FIG. 2 is a top plan view of the putter of FIG. 1.
Figure 3:
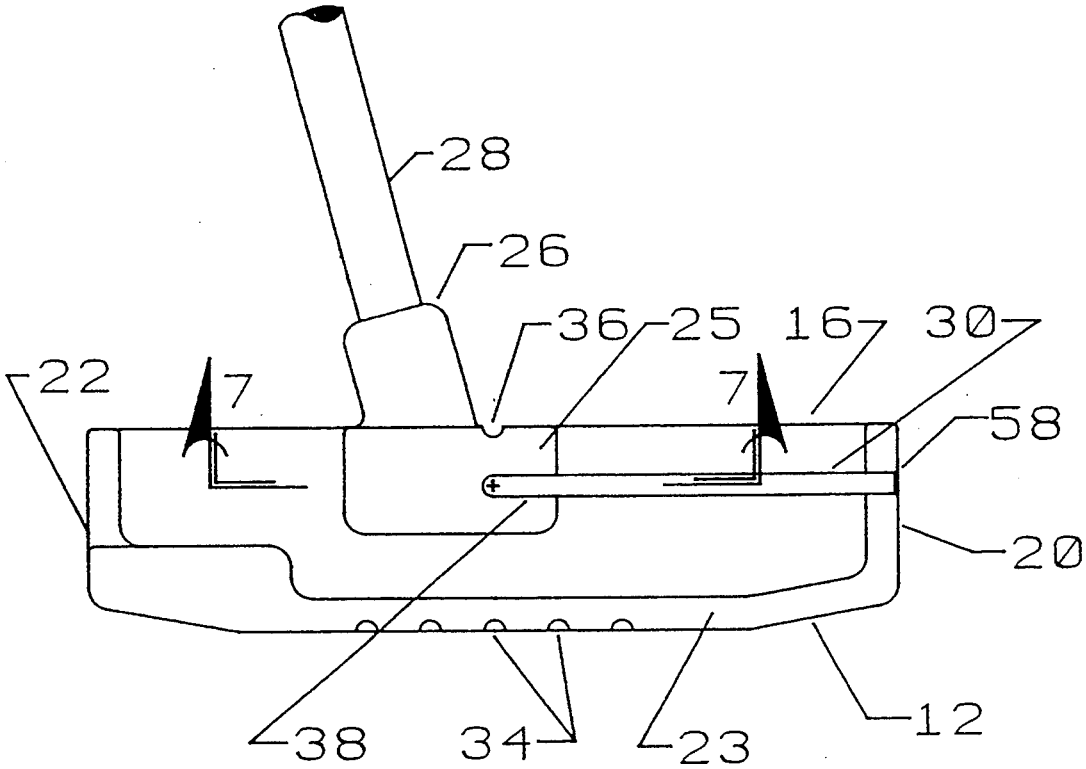
FIG. 3 is a rear elevation of the putter of FIG. 1 illustrating the aiming arm in its folded position.
Figure 4:
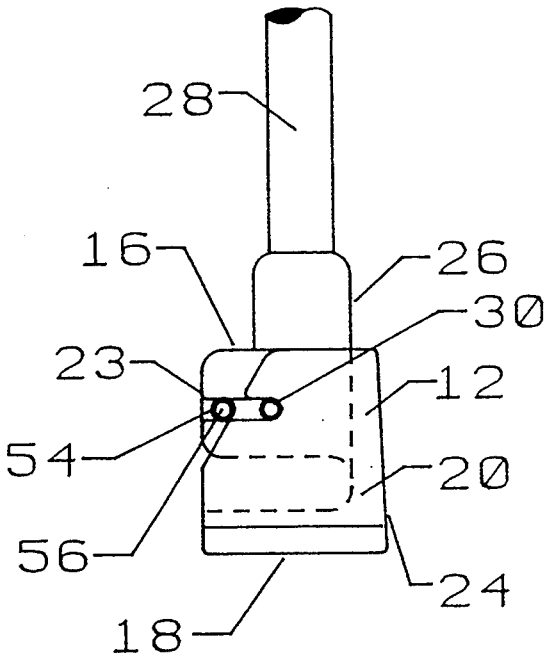
FIG. 4 is an end elevation, viewed from the toe of the putter of FIG. 1.
Figure 5:
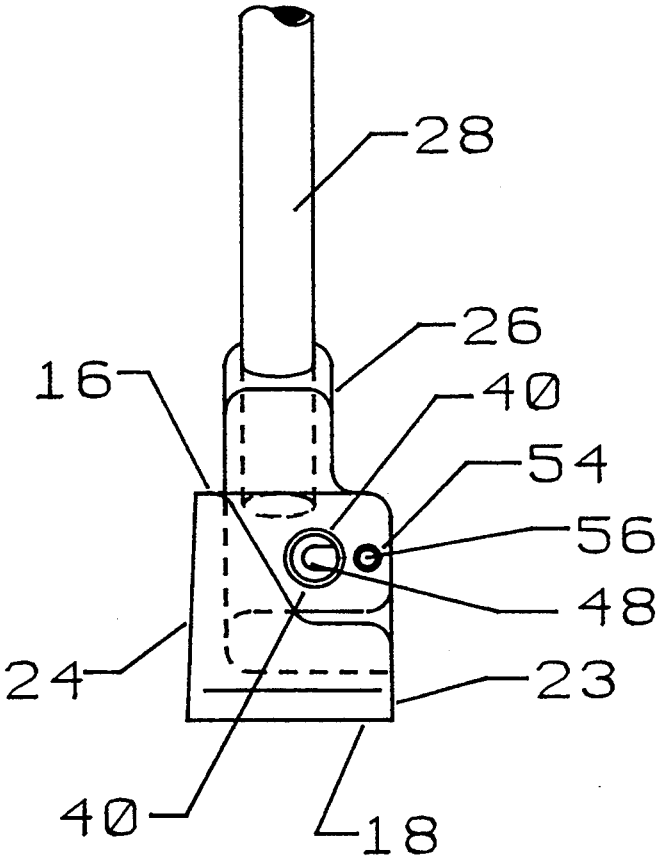
FIG. 5 is an end elevation, viewed from the heel of the putter of FIG. 1.

Referring to FIGS. 1–3, a putter 10 designed in accordance with the present invention is shown. The putter 10 consists of a club head 12 which defines a top surface 16, a sole 18, a toe 20 and a heel 22 and a rear surface 23. The planer front surface of the club head 12 defines the striking face 24 and it is slightly biased from the vertical plane as is conventional in putters. The top surface 16 includes a hosel 26 which is adapted to receive one end of a shaft 28.

In accordance with the invention, an aiming arm 30 is pivotally mounted in the rear surface 23 of the club head 12 for movement between an operative position in which the arm 30 extends perpendicularly to the striking face 24 and a folded position generally parallel to the rear surface 23 of the club. In the embodiment illustrated, the rear surface 23 of the club head 12 is provided with a pair of cavities 32 which open to the top surface 16 of the club head 12. A counter weight 33 may be formed in the cavity 32 adjacent the heel 22 to provide balance and improved feel to the club. The median portion of the club between the cavities, referred to as a mounting base 25, carries the hosel 26 and pivotally carries the aiming arm 30 and the means for securing the aiming arm as will be explained in more detail below. The heel 22 of the club is cut away to provide access to the mounting base 25. A series of grooves 34 on the sole 18 of the club head 12 aid in maintaining the line of the club head as it is moved over the surface of the green while striking the ball. An alignment groove 36 on the top surface 16 of the club head 12 is vertically aligned with the aiming arm 30 acts as a guide to insure that the player's head is in the proper position over the ball when preparing to putt.

The aiming arm 30 is pivotally mounted in the rear surface 23 of the mounting base 25 and it pivots between an operative position extending perpendicularly to the striking face 24 of the club head 12 and a folded position in which the arm lies essentially parallel with the rear surface 23 of the club head. A slot 38 opening to the toe 20 and the rear surface 23 is formed in the mounting base 25 so that the arm can swing from its folded position to its extended position. A first passage 40 extends from the side surface of the mounting base 25 facing the heel 22 and opens into the slot 38. The diameter of the first passage 40 is larger than the height of the slot 38 opening of the first passage to the slot defines a socket 42. One end of the aiming arm 30 carries a swivel ball 44 which is received in the socket 42 and provides the pivot point about which the arm can swing between its operative position and its folded position. The swivel ball 44 is provided with a circumferential groove 46 which is located outwardly from the equator of the ball 44 toward the arm 30. The groove 46 is shallow and defines a camming surface. The first passage 40 is threaded and receives a threaded cylinder 48 in which is disposed a spring and a retractable plunger 50 which is urged by the spring into the groove 46 when the arm 30 is swung in its operative position to secure the arm in that position. The pole of the swivel ball 44 opposite the arm 30 is provided with a dimple 52 into which the spring loaded plunger 50 is received when the arm 30 is in the folded position to serve as a detent for securing the arm in that position. A second passage 54 extends parallel to the first passage 40 from the heel facing surface of the mounting base 25 to open into the slot 38. A set screw 56 is received in the second passage 54. The end of the set screw 56 acts as a stop to limit the travel of the aiming arm 30 and to cooperate with spring loaded plunger 50 to maintain the aiming arm in a perpendicular orientation with respect to the striking face 24 of the club head 12. A second slot 58 the rear surface 23 of the club head 12 at the toe 18 receives the end portion of the aiming arm 30 when it is in the folded position.

To assemble the aiming arm 30 onto the club head 12, the arm is inserted through the first passage 40 toward the toe 20 until the swivel ball 44 is received in the socket 42 and the arm is pivoted to a position intermediate the folded and the operative positions. The threaded cylinder 48 is positioned in the first passage 40 with the end of the spring loaded plunger 50 in contact with the swivel ball 44 to compress the spring. The aiming arm is pivoted to its folded position allowing the spring to urge the spring loaded plunger 50 into the dimple 52. When the aiming arm 30 is pivoted into its operative extended position, the spring loaded plunger 50 is cammed out of the dimple 52 retracting the plunger in the cylindrical member 48 and compressing the spring. The swivel ball 44 pivots in the socket 42 until the circumferential groove 46 is aligned with the spring loaded plunger 50 whereupon it is urged into the groove by the action of the spring.

Figure 6:
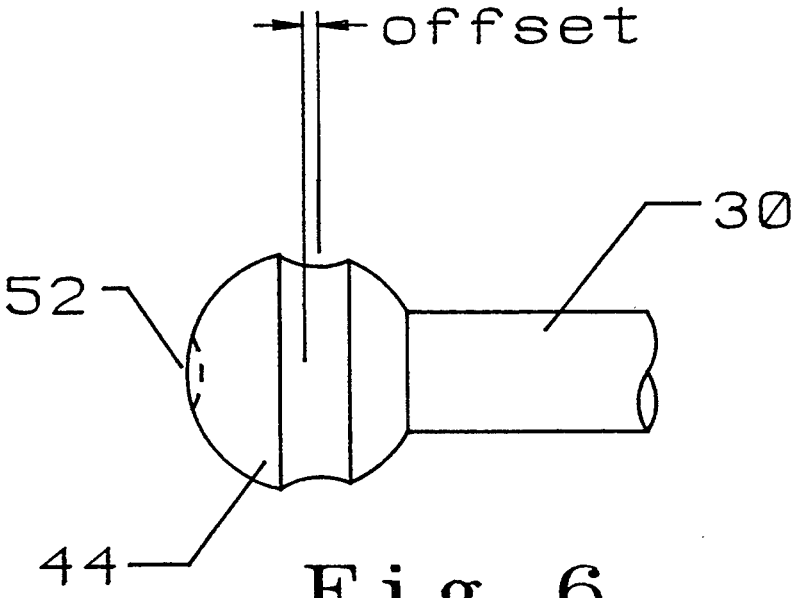
FIG. 6 is an enlarged scale view partially broken away for compactness of illustration of one end of the arm mounted in the putter head.
Figure 7:
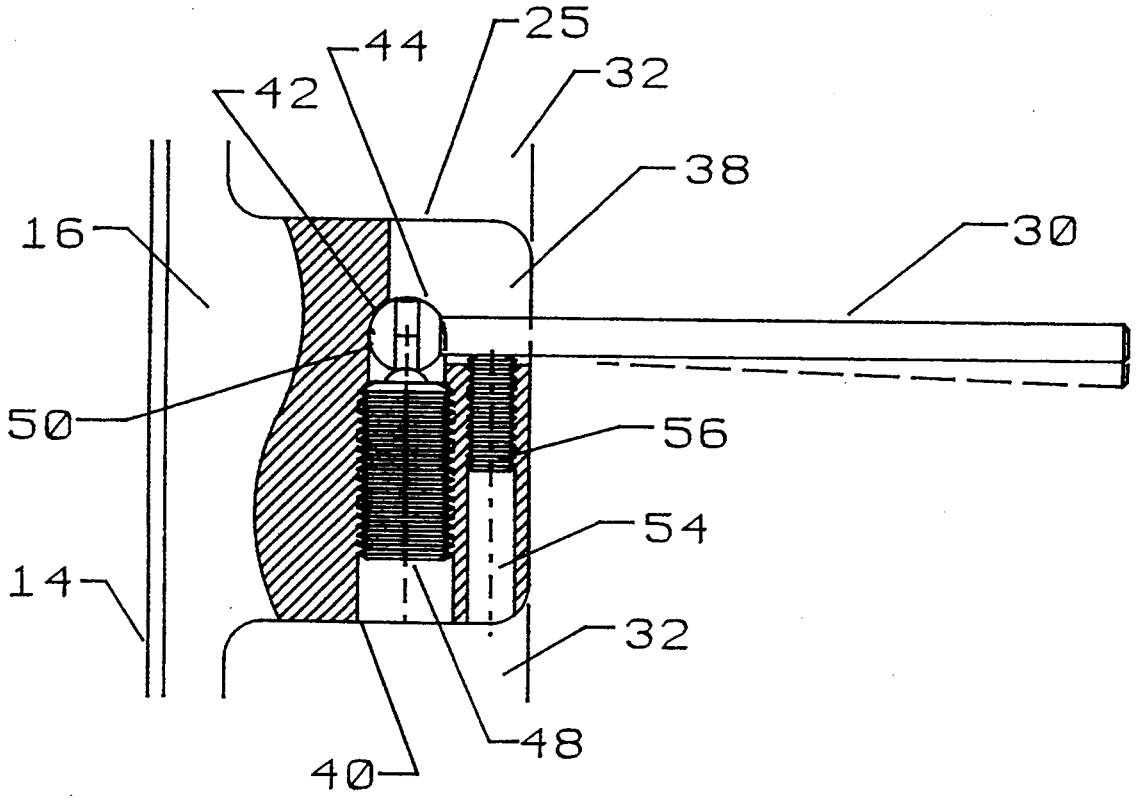
FIG. 7 is a sectional view, in enlarged scale and partially broken away for compactness of illustration, of the club head and aiming arm mounted therein showing the securing means and adjustable stop means of the present invention.

As most clearly illustrated in FIG. 6, the center of the circumferential groove 46 is located outwardly toward the aiming arm 30 from the equator of the swivel ball 44. In this manner the aiming arm 30 can pivot past its perpendicular position with respect to the striking face 24 of the club head 12. The adjustable set screw 56 is then tightened down against the arm until the arm is precisely perpendicular to striking face 24 of the club head 12. Once so adjusted, the set screw 56 acts as a stop to prevent travel of the aiming arm 30 past its perpendicular position.

As previously mentioned, minor variations in the relative perpendicularity of the aiming arm 30 can result in misalignment of the club head 12 and missed putts due to such misalignment. It would become apparent that machining tolerances therefore are critical in devices of this type. However, the close tolerances that would be required to achieve accurate positioning of the aiming arm 30 would substantially increase the price of the putter design in accordance with the present invention. Accordingly the positioning of the circumferential groove 46 away from the equator of the swivel ball 44 permits the aiming arm 30 to swing past its perpendicular position during initial assembly where upon it can be set back to its correct perpendicularity by the adjustable set screw 56. This is normally done at the factory while manufacturing and assembling the putter of the present invention. Thereafter the set screw 56 acts as stop so that the aiming arm 30 is restricted in its travel to an arc of approximately 90 degrees with respect to the striking face 24 of the club head 12 and the set screw 56 cooperates with the spring loaded plunger to maintain the arm in its perpendicular operative position. The aiming arm 30 can be returned to its folded position by applying force against the arm causing the spring loaded plunger 50 to be cammed out of the circumferential groove 46 and retract in the threaded cylinder 48 and compress the spring. The spring loaded plunger rides on the surface of the swivel ball 44 while it is pivoting to its folded position until it becomes aligned again with the dimple 52 on the swivel ball to secure the aiming arm 30 in its folded position.

The invention has been described in conjunction with an embodiment of a putter having a pair of cavities 32 in the rear surface 23 of the club head 12. It will be apparent that the device can be applied a club head 12 without cavities by elongating the slot 38 and by elongating the first and second passages, 40 and 54 respectively, to extend from the slot to open up the heel surface of the club head.

Thus, while the invention has been described in conjunction with certain preferred embodiments thereof, it will be apparent to those skilled in the art that various modifications and arrangements can be made all of which are within the scope of the appended claims.

Having defined the invention, I claim:

1. A golf putter including a club head defining a front striking face, a rear surface, an upper surface, a sole surface, a heel and a toe, an upwardly extended hosel defined on the upper surface, a shaft received in said hosel and having grip means on its extending end, an aiming arm having one end pivotally mounted in a socket disposed in the rear surface of the club head intermediate the toe and the heel, a slot communicating between the socket and the rear surface for movement of the aiming arm between a folded position essentially parallel with the rear surface of the club head and an operative position extending from the rear surface perpendicular to the striking face of the club head, the invention comprising:

securing means for retaining the aiming arm in the folded and the operative positions comprising a first threaded passage communicating with the socket, a threaded cylinder carrying a spring and a retractable plunger being disposed in the first threaded passage, the plunger being urged by the spring against the one end of the aiming arm.

2. The golf putter of claim 1 further including adjustable stop means cooperating with the securing means to maintain the aiming arm in a position perpendicular to the striking face of the club head when the arm is in the operative position, the adjustable stop means comprising a second passage extending parallel to the first passage opening to the slot, an adjustable stop threadibly disposed in the second passage, the adjustable stop contacting the aiming arm to limit the travel thereof and to cooperate with the spring loaded plunger to maintain the aiming arm in perpendicular orientation with respect to the striking face of the club head.

3. The golf putter of claim 1 wherein a swivel ball is disposed on said one end of said aiming arm, said swivel ball is received in said socket for pivotally mounting said aiming arm.

4. The golf putter of claim 3 wherein said swivel ball further includes a circumferential groove extending about said swivel ball parallel to the equator thereof, the center of said circumferential groove being located outwardly towards said aiming arm from the equator of said swivel ball.

5. The golf putter of claim 4 wherein said circumferential groove defines a camming surface for said plunger for securing said aiming arm in the operative position.

6. The golf putter of claim 3 wherein said swivel ball further includes a dimple on the pole of said swivel ball opposite said aiming arm, said dimple receiving said plunger to define a detent for securing said aiming arm in the folded position.

* * * * *